United States Patent [19]

Fujii et al.

[11] Patent Number: 5,074,443

[45] Date of Patent: Dec. 24, 1991

[54] ADAPTOR FOR LIQUID DISPENSING SYRINGE

[75] Inventors: Hideyo Fujii, Tokyo; Takaji Shimada, Kawaguchi; Yukinaga Ohtani, Yokohama; Kazuteru Esawa, Tokyo, all of Japan

[73] Assignee: Nordson Corporation, Westlake, Ohio

[21] Appl. No.: 453,812

[22] Filed: Dec. 20, 1989

[51] Int. Cl.[5] ..... B67D 5/08

[52] U.S. Cl. ..... 222/639; 118/684; 222/325; 222/399; 222/504

[58] Field of Search ..... 222/638–639, 222/181, 183, 185, 320, 325, 394, 399, 504, 510; 118/684, 696

[56] References Cited

U.S. PATENT DOCUMENTS

| | | | |
|---|---|---|---|
| 2,964,246 | 12/1960 | Alholm et al. | 222/504 X |
| 3,943,527 | 3/1976 | Hartmann | 222/108 X |
| 3,982,724 | 9/1976 | Citrin | 222/504 X |
| 4,437,586 | 3/1984 | Columbus | 222/181 |
| 4,784,582 | 11/1988 | Howseman, Jr. | 417/375 |
| 4,801,051 | 1/1989 | Lewis et al. | 222/309 |
| 4,848,606 | 7/1989 | Taguchi et al. | 222/333 |
| 4,874,444 | 10/1989 | Satou et al. | 118/679 X |
| 4,922,852 | 5/1990 | Price | 118/683 |

FOREIGN PATENT DOCUMENTS

| | | | |
|---|---|---|---|
| 85223 | 6/1980 | Japan | 222/390 |
| 149087 | 11/1961 | U.S.S.R. | 118/684 |

*Primary Examiner*—Donald T. Hajec

*Attorney, Agent, or Firm*—Wood, Herron & Evans

[57] ABSTRACT

An adaptor for liquid dispensing of precisely controlled amounts through an outlet of a liquid filled syringe includes a valve shaft extended through an inlet of the syringe, along the syringe and seated against a valve seat assembly at the outlet of the syringe. The valve seat assembly and a cylindrical casing cooperatively mount the syringe to a housing assembly. A spring within the housing assembly biases the valve shaft to a normally closed position against the valve seat assembly. By pressurizing the liquid in the syringe, timer actuation of a solenoid within the housing assembly retracts the valve shaft away from the valve seat assembly to an open position to force the pressurized liquid through the outlet and out of the syringe.

13 Claims, 4 Drawing Sheets

ADAPTOR FOR LIQUID DISPENSING SYRINGE

FIELD OF THE INVENTION

This invention relates to the dispensing of liquid from a syringe. More particularly, this invention relates to an adaptor that provides precise control in dispensing quantified amounts of liquid from a disposable syringe.

BACKGROUND OF THE INVENTION

In conventional dispensing of material from a syringe, pressurized air supplied to the upper, larger end of the syringe forces the material out of the lower, smaller end or tip of the syringe. Typically, plastic, disposable syringes used in dispensing of this type are purchased in a liquid-filled condition, with removable plugs connected to both the upper and lower ends of the syringe to contain the liquid.

To dispense liquid from such a syringe, the plugs are removed, a nozzle is placed on the lower end of the syringe, and a compressed air supply is connected to the upper end. A source of compressed air is usually controlled by a timer to supply pressure to the upper end of the syringe in order to dispense liquid out of the nozzle for a selectable time duration.

In many dispensing applications, the amount of liquid dispensed is determined by multiplying an approximate flow rate of discharge by the time duration of dispensing. The flow rate of discharge is calculated from the velocity of discharge flow, the viscosity of the liquid in the syringe and size of the outlet. Basically, because the latter two parameters do not vary substantially during dispensing the contents of a syringe, the flow rate of discharge, in volume per unit time, of the liquid dispensed from the nozzle is dictated by the velocity of discharge flow, in distance per unit time. Thus, the velocity of discharge flow is approximately proportional to the internal pressure of the syringe.

In syringe dispensing of the type described, the internal syringe pressure undergoes an initial ramp increase, remains constant for a while, then undergoes a final ramp decrease to zero. Similarly, as pressure increases, the velocity undergoes a corresponding increase. After the pressure eventually reaches a predetermined, set level, the velocity of discharge flow of the liquid becomes a constant that is proportional to the internal syringe pressure. When the internal pressure of the syringe is decreased, eventually toward vacuum, the velocity gradually decreases. When the internal air pressure reaches zero, dispensing velocity from the nozzle subsequently stops altogether. In other words, the velocity of discharge is not constant throughout an entire dispensing interval, but rather undergoes an initial ramp increase and a subsequent ramp decrease which reflect the corresponding pressure ramps.

This invariably leads to problems in attempting to dispense a precise quantitative amount of liquid from the syringe. If a timer actuated valve is used to supply pressurized air to the top of the syringe from a compressor during a time period of selectable duration, and the time period selected is based upon the assumption that velocity of discharge flow is constant throughout the time period, there will be a discrepancy between the amount of liquid desired to be dispensed and the actual amount dispensed. This discrepancy results directly from the aforementioned ramping of the supplied pressure and the corresponding velocity ramping.

The effects of this problem become more acute when dispensing for very short time periods, where there is an increase in the proportion of the time period in which internal syringe pressure is either ramping up or ramping down with respect to that portion of the time period when the internal syringe pressure is constant.

Stringing, or sticking, of a bead of the liquid to the nozzle also adversely effects the ability to dispense precise quantitative amounts of liquid. Stringing is most likely to occur at lower pressures, for instance when the pressure is ramping up or ramping down. For this reason, stringing also becomes more acute as dispensing time decreases. Stringing of the liquid from the nozzle tip during the final stage of dispensing may be avoided to some extent by making the internal pressure of the syringe negative. However, when dispensing again commences, a build-up of liquid at the nozzle tip almost invariably occurs, thus adversely affecting the stability of the subsequent extrusion.

Additionally, by varying the internal syringe pressure from positive to negative, some evaporation of liquid from the syringe will occur. This evaporation increases the viscosity of the liquid remaining in the syringe. As a result, additional force is required to dispense a desired amount and coverage efficiency is reduced. In short, the increase in viscosity makes it difficult to establish a precise, consistent relationship between applied air pressure and velocity of discharge flow during the course of dispensing the entire contents of a syringe.

Another approach to dispensing fluid from a syringe is disclosed in U.S. Pat. No. 4,784,582, entitled "Fluid Dispensing Pump." This pneumatically operated pump includes an axially movable plunger that extends through the syringe and normally fits into and blocks a dispensing hole. When the plunger is lifted a predetermined amount by an air actuated piston, liquid under pressure flows into the space vacated by the withdrawn plunger. Upon spring actuated return of the plunger to its normal position, a column of liquid in the space is shot through the dispensing hole.

Although this device enables small measured quantities to be dispensed from the syringe, only limited amounts can be dispensed at any one time, with one plunger stroke required for each dispensing amount. Thus, an excessive amount of energy is required in order to dispense the entire contents of a syringe. While the diameter and length of the plunger and plunger column could be increased in order to increase the amount of liquid that can be dispensed in any single plunger stroke, this would also require additional energy to lift the air actuated piston in order to withdraw the plunger.

Another disadvantage results from the fact that, regardless of variation in the viscosities of different liquids that are dispensed from syringes of this type, unless the spring is changed, the down stroke force will always be the same. Thus, the exit velocity, and the liquid coverage will have to be calculated differently if liquids of varying viscosity are used.

It is therefore an object of this invention to improve accuracy, precision and energy efficiency in dispensing quantitative amounts of liquid from a syringe.

SUMMARY OF THE INVENTION

The invention contemplates controlled dispensing of liquid through a syringe outlet by supplying constant air pressure to the interior of the syringe through an inlet and selectably retracting a valve shaft from a valve seat located at the syringe outlet in order to enable the pressurized liquid to be ejected through the outlet and out of the syringe. The valve shaft extends through the inlet along the interior of the syringe, to a valve seat at the outlet where it is spring biased against the valve seat to a normally closed position. The valve shaft is retracted by a solenoid located in a housing assembly at the inlet of the syringe.

In accordance with a preferred embodiment of the invention, an adaptor for liquid dispensing from a syringe includes a housing assembly, a valve seat assembly, an outer casing, a valve shaft, a retaining plug, a spring, a solenoid, a timer, and a micrometer. The valve seat assembly is threadably connected to the outlet of a store-bought, liquid-filled syringe from which the outlet plug has been removed. The valve seat assembly also supports or retains an outer tubular shaped sleeve or casing sized to receive the syringe. An opposite end of the casing connects to the housing assembly to hold the syringe thereto. A retaining plug inserted into the rear end or inlet of the syringe has an orifice through which the valve shaft passes. The valve shaft extends through the syringe to the outlet where it engages the valve seat assembly. The opposite or rear end of the valve shaft extends above the retaining plug into the housing assembly, where it is spring biased downwardly to seal the valve shaft and the valve seat assembly in a normally closed position. The rear end of the valve shaft is controlled by a solenoid so that actuation of the solenoid retracts the valve shaft from the valve seat assembly.

Pressurized air is supplied to the interior of the syringe via a clearance in the retaining plug between the valve shaft and the orifice. The timer actuates the solenoid to retract the valve shaft from the valve seat assembly for a selectable duration, during which duration the valve is opened to enable outlet and out of the syringe. The micrometer contacts the rear end of the valve shaft and is adjustable to enable an operator to adjust the valve stroke, or the retracting travel distance of the sealed tip of the valve shaft.

With this adaptor, the internal pressure of the syringe remains substantially constant throughout dispensing. The internal pressure has two separate components, the positive pressure supplied from the compressor, which may be supplied continuously before, during and after retraction of the valve shaft, and the negative pressure, or pressure drop, that occurs when the valve shaft is retracted. When plotted versus time, both of these pressure components have the shape of a square wave. Because the resultant internal pressure of the syringe is substantially constant during dispensing, or in the shape of a square wave when plotted versus time, the velocity of discharge flow also takes on a square wave shape. There is no ramp up to a constant velocity at the initial stages of dispensing followed by a ramp downward to zero velocity at the end of dispensing. Therefore, with velocity of discharge flow substantially constant, constant flow rate of discharge is achieved and precise quantifiable dispensing depends only upon determining that flow rate and setting the timer to correspond to a dispensing time necessary to dispense the desired amount at that rate.

The absence of a pressure ramp reduces the occurrence of stringing. Additionally, the surfaces of the valve shaft and the valve seat assembly coact to significantly reduce stringing at the nozzle. Therefore it is not necessary to draw a vacuum on the syringe when dispensing ceases, and the liquid in the syringe is not subject to a viscosity increase.

Additionally, because this adaptor alleviates the need to evacuate air from the inside of the syringe, the viscosity of the liquid in the syringe remains consistent until it is emptied, thus further insuring accuracy and repeatability in quantifiable dispensing of the entire contents of a syringe.

These and other features of the invention will be more readily understood in view of the following detailed descriptions and drawings in which:

DETAILED DESCRIPTION OF THE DRAWINGS

Figure 1:
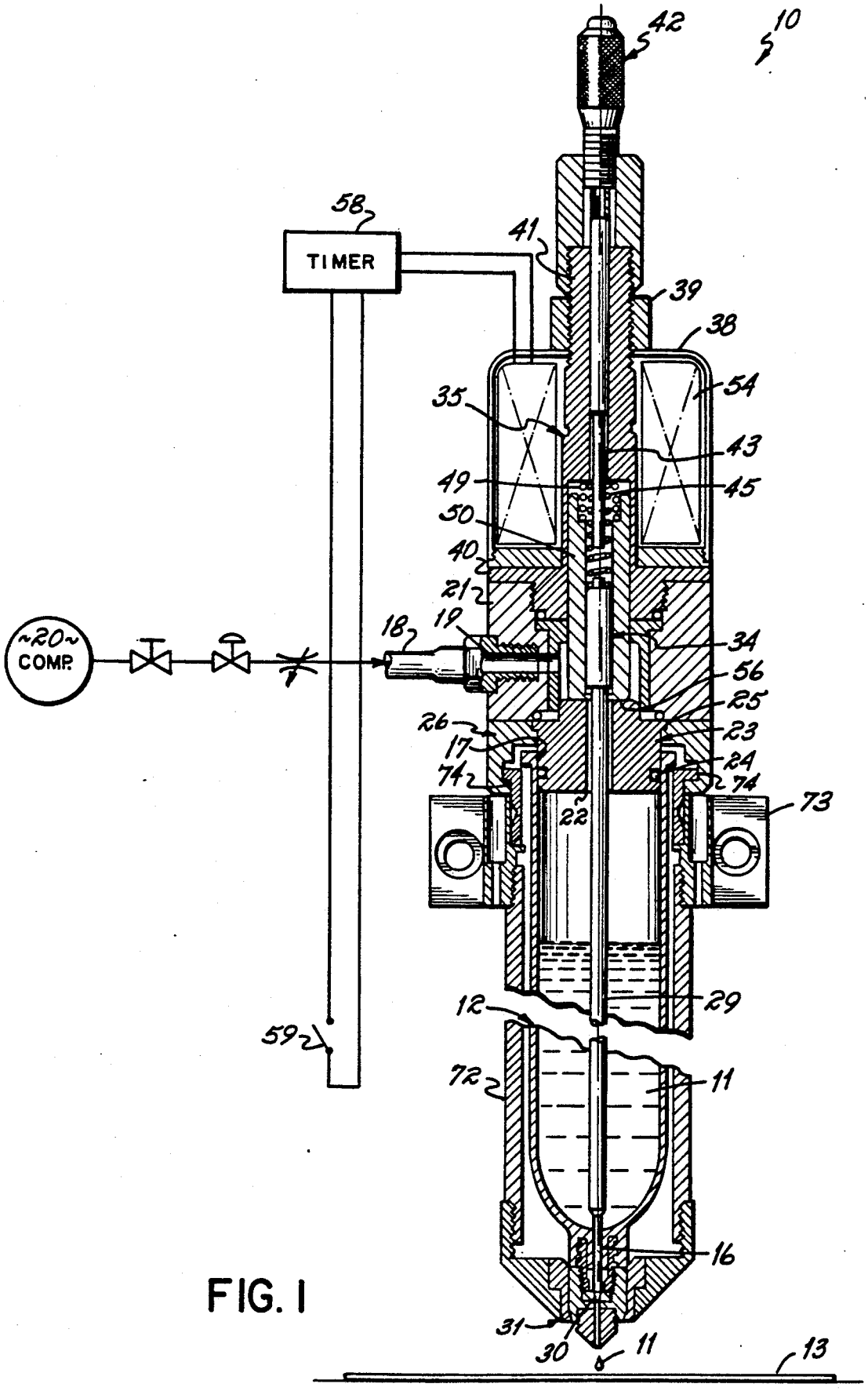
FIG. 1 is a schematic cross sectional view showing an adaptor in accordance with a preferred embodiment of the invention, during dispensing of liquid from a syringe onto a substrate.

FIG. 1 shows an adaptor 10 for use in dispensing liquid 11 from a store bought, liquid filled syringe 12 onto a substrate 13, or other surface. While the invention is particularly suitable for dispensing of liquid or ink in the formation or coating of electrical components or circuit boards, the invention would be equally suitable for any type of quantitative dispensing of a liquid from a syringe. The syringe 12 is purchased in a liquid filled condition, with plugs or caps (not shown) sealing both the outlet 16 of the syringe 12 (or the bottom as shown in FIG. 1) and the inlet 17, (or the top of the syringe 12 as viewed in FIG. 1). Typically, syringes of this type are made of plastic, typically polyethylene or polypropylene, and have a diameter of 15 to 25 millimeters and a length of 100 to 300 millimeters with wall thickness of 1 to 1.5 millimeters. Some syringes have a capacity or internal volume of about 500 cubic centimeters.

In order to dispense the liquid 11 from the syringe 12, the plugs are removed from the outlet 16 and inlet 17 and the syringe is placed within the adaptor 10. Pressurized air from a compressor 20 is supplied to the inlet end 17 of the syringe 12 in order to pressurize the liquid 11 therein. Typically, the compressor 20 pressurizes the liquid 11 in the syringe 12 to a pressure in the range of about 0.5 to 0.7 $kg/cm^2$. Compressed air is supplied via a line 18 to a passage 19 formed in air housing 21. The passage 19 communicates with an orifice 22 in a retaining plug 23 seated within the inlet 17 of the syringe 12. The seal between retaining plug 23 and syringe 12 is maintained by an O-ring 24. To mount the syringe 12, an upper flange 25 of the retaining plug 23 is supported by a casing holder 26 which is secured by bolts (not shown) to housing 21.

A valve shaft 29 also extends through the orifice 22, along the entire interior length of the mounted syringe 12, with a tip 30 thereof seated against a valve seat assembly 31. An opposite end of the valve shaft 29 extends rearwardly (or upwardly, as viewed in FIG. 1)

from plug 23 into the air housing 21 of the adaptor 10. An increased diameter section 34 resides at this upper end. The housing 21 is threadably secured to a connector 35 which extends upwardly within a solenoid housing 38 and is secured by a nut 39 exterior of housing 38. A lower end 40 of connector 35 supports solenoid housing 38. An upper end 41 of connector 35 is threaded to a micrometer assembly 42 which includes a downwardly projecting shaft 43. The bottom end of shaft 43 stops upward travel of valve shaft 29 to control the length of retraction of tip 30 from valve seat assembly 31.

An inner spring 45 engages a top surface 46 of the increased diameter section 34 of valve shaft 29 to press the valve shaft 29 downwardly against valve seat assembly 31 to a normally closed position. An outer spring 49 biases an armature 50 away from a solenoid 54 located in solenoid housing 38. When solenoid 54 is energized, armature 50 is retracted upwardly within the solenoid 54 and an interior, bottom armature shoulder 56 engages a bottom surface 52 of section 34 to retract valve shaft 29 and open the valve. The valve shaft 29 is retracted until it engages micrometer shaft 43.

Preferably, the solenoid 54 is actuated by a signal from a timer 58 to retract the valve shaft 29 from its unseated position for a selectable time duration. An initial dispensing signal may be provided by a separate switch 59 to actuate the timer 58, such as, for instance, a foot switch 59 as shown in FIG. 1. Preferably, the timer 58 allows dispensing for time durations ranging from 0.005 seconds to 10 seconds. With the liquid 11 in the syringe 12 pressurized, upward retraction of the valve shaft 29 from valve seat assembly 30 enables liquid to be ejected through the outlet 16 and out of the syringe 12 for a time duration set by the timer 58.

Figure 2:
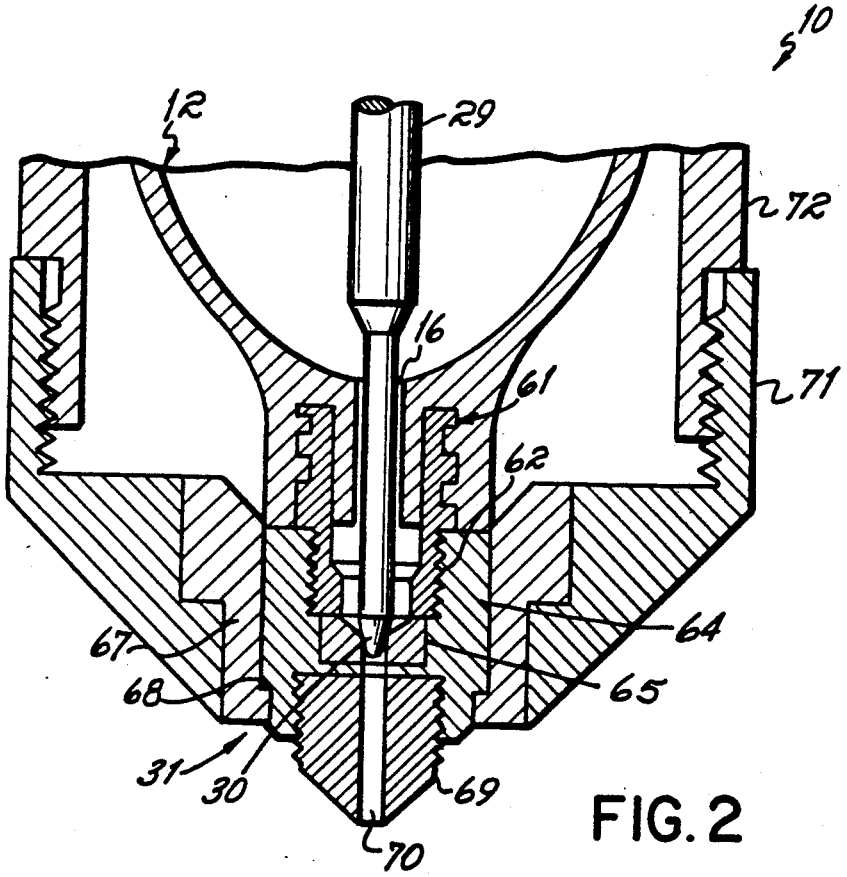
FIG. 2 is an enlarged view of the outlet of the adaptor shown in FIG. 1, with the syringe mounted in place within the adaptor.

FIG. 2 shows an enlarged view of the outlet 16 of the syringe 12 and the valve seat assembly 31. The valve seat assembly 31 includes a double threaded extender 61 which is threadably received within the outlet 16 of the syringe 12. A bottom portion 62 of the extender 61 is held by a valve seat holder 64. The valve seat holder 64 also retains a valve seat 65, which coacts with the tip 30 of the valve shaft 29 to prevent liquid 11 flow through the outlet 16 when in the normally closed position. A retainer 67 has an annular shoulder 68 that supports valve seat holder 64. A nozzle 69 is threadably received within valve seat holder 64, and is located downstream of valve seat 65. The nozzle 69, the valve seat 65 and the valve seat holder 64 have a passage 70 formed therethrough that is aligned with outlet 16.

The retainer 67 is held by an end cap 71 that is threadably connected to an exterior cylindrical sleeve or casing 72 which extends upward to surround and encase the syringe 12. The casing 72 protects the substrate 13 from spillage of the liquid 11 if the syringe 12 should accidentally break and acts as a guide or support means for the lower dispensing end of the syringe 12. Both the casing 72 and the syringe 12 may be transparent so that an operator may determine the remaining level of liquid 11. As shown in FIG. 1, the casing 72 is threadably received within a robot mounting bracket 73, which is held to casing holder 26 by an upper flange of a two eared connector 74. The mounting bracket 73 enables the entire adaptor 10 to be mounted to a programmable robot arm or XYZ plotter (not shown) to precisely control the dispensing pattern of the liquid on the substrate 13.

Together, the valve seat assembly 31, the end cap 71 and the sleeve 72 work against the spring 45 to provide upward force against the tip 30 of the valve shaft 29 in order to maintain the valve shaft 29 in a centered, normally closed position within the syringe 12. Preferably, the travel or retracting distance of the valve shaft 29 is limited so that it always remains within either the outlet 16 of the syringe 12 or the passage 70.

In operation, the plugs (not shown) of a liquid-filled syringe 12 are removed. At outlet 16, all of the structural parts forming the valve seat assembly 31, that is, extender 61, valve seat holder 64, valve seat 65, retainer 67 and nozzle 69 are attached. The retaining plug 23 and O-ring 24 are fitted within inlet 17, and valve shaft 29 is extended through orifice 22. Casing 72 is then placed over the syringe 12 and threaded to the bracket 73, and end cap 71 is placed over the bottom of valve seat assembly 31 and threadably connected to the bottom of the casing 72 to complete mounting of the syringe 12 to the adaptor 10.

Figure 3:
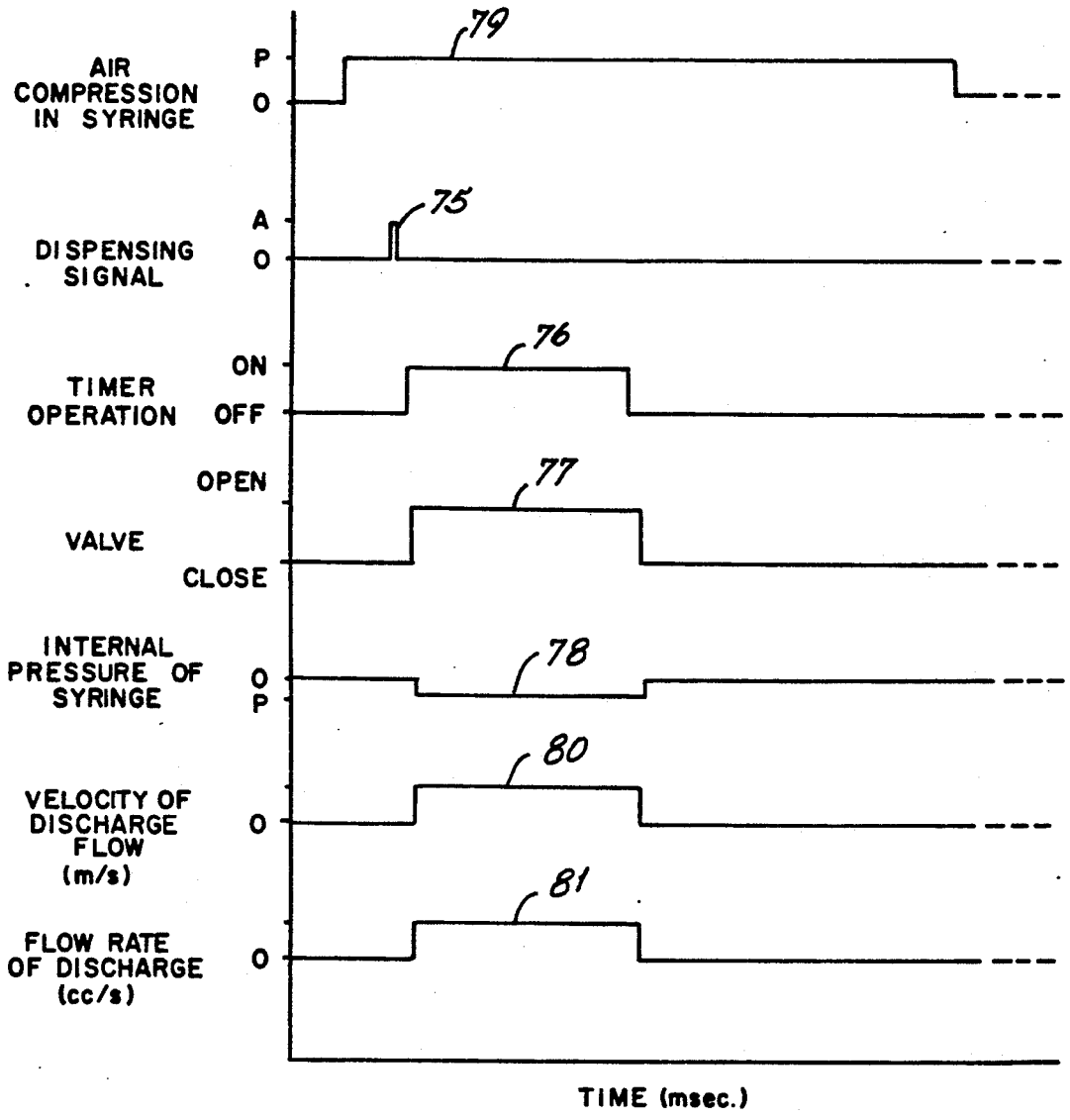
FIG. 3 is a graph showing various dispensing parameters plotted versus time for an adaptor in accordance with a preferred embodiment of the invention.

Pressurized air is supplied to the interior of the syringe 12 by air compressor 20, via line 18, passage 19 and orifice 22. As shown in FIGS. 1 and 3, upon timer 58 actuation of the solenoid 54 via a dispensing signal 75, the tip 30 of valve shaft 29 retracts from the seated position against the valve seat 65 and the pressurized liquid 11 is forced through the outlet 16, the passage 70 and out of the syringe 12 for a selectable time duration, shown as a timer duration signal 76. As shown by a valve signal 77 that represents the valve condition, opening and closing of the valve precisely corresponds to the timing signal 76, with a slight time lag. Similarly, the internal pressure drop in the syringe 12 that occurs when the valve is opened also takes the form of a square wave, shown as pressure drop signal 78. Air compression in the syringe, shown as signal 79, remains substantially constant before, during and after dispensing. Finally, and perhaps most importantly, velocity of discharge flow and flow rate of discharge, represented by square waves 80 and 81, respectively, correspond precisely to the pressure and timer signals, so that accurate control is achieved in dispensing quantitative amounts of liquid from the syringe 12.

Figure 4:
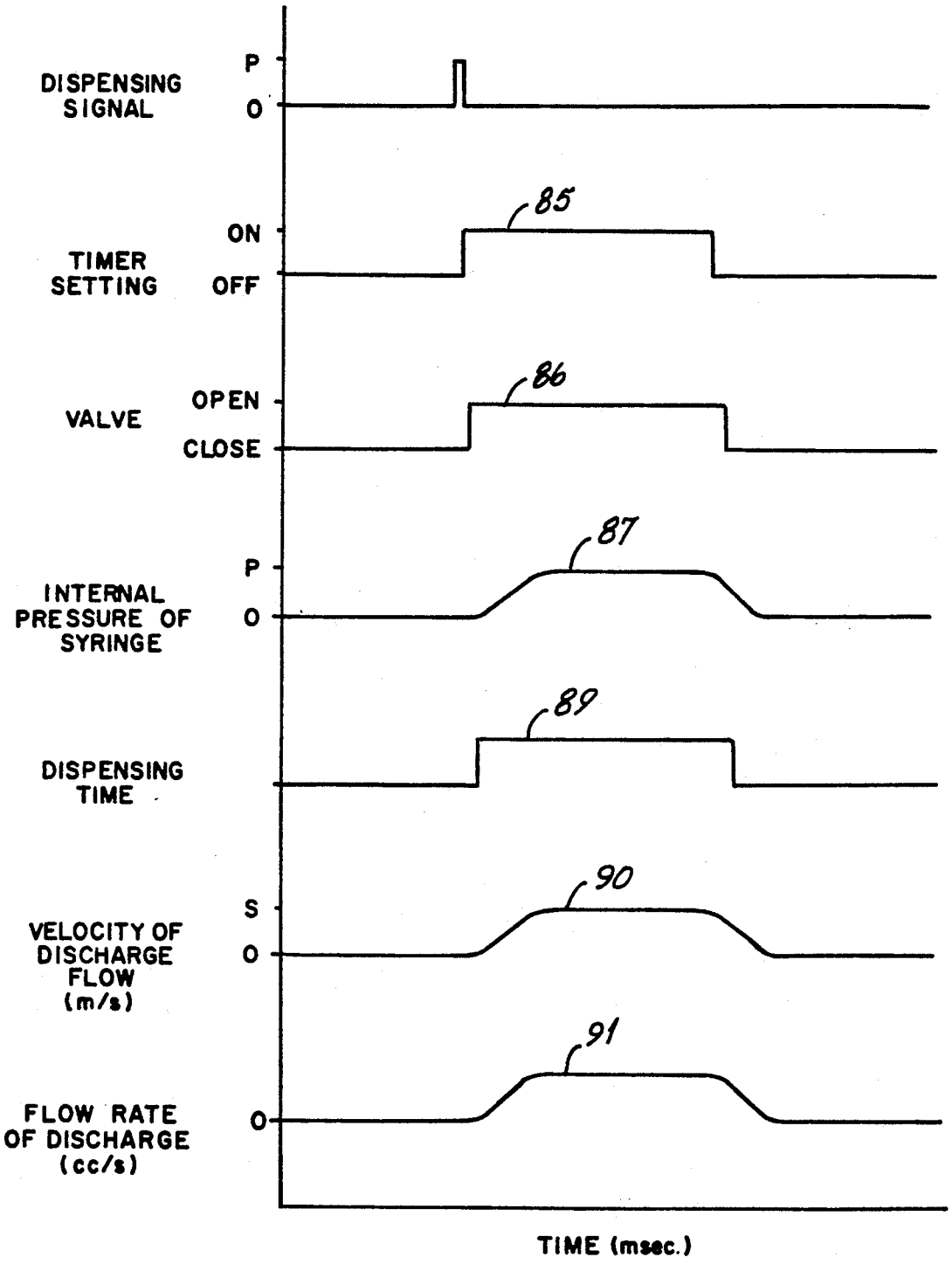
PRIOR ART FIG.4
FIG. 4 is a graph showing various dispensing parameters plotted versus time for a prior art syringe dispensing system.

Contrast the signals depicted in FIG. 3 with those of FIG. 4, which depicts signal representations obtained with a prior art dispensing apparatus of the pneumatic type initially described in the background section of this application. Note that while the timer signal 85, the valve signal 86 and the dispensing time 89 are square waves, the signals depicting internal syringe pressure 87, velocity of discharge flow 90 and the flow rate of discharge 91 are sloped or ramped and not square in shape.

While a preferred embodiment of the invention has been described, it is to be understood that various modifications could be made without departing from the spirit of the invention. For instance, variation in the size and/or shape of the syringe would require a corresponding alteration in adaptor dimensions, but this would not materially effect the applicability of this invention. Moreover, structural equivalents may be substituted to perform the same function as the components described herein, for example, an air-actuated piston could be substituted for the solenoid 54 to control retraction of the valve shaft 25. Accordingly, it is to be understood that changes may be made without departing from the scope of the invention as particularly set out and claimed.

We claim:

1. An adaptor for dispensing of liquid from an outlet of a syringe comprising:

syringe support means adapted to hold the syringe in a dispensing position;

a normally closed valve located at one end of said syringe support means;

means for pressurizing the liquid in the syringe when the syringe is held by said support means; and valve control means located at an opposite end of said syringe support means and adapted to extend through an inlet of said syringe along the interior of said syringe and to said outlet when the syringe is held by said support means, said valve control means further being adapted to open said valve in order to enable said pressurized liquid to be ejected through said outlet and out of the syringe, said valve control means being controllable independently of said means for pressurizing.

2. The adaptor of claim 1 wherein said mean for pressurizing comprises a compressor adapted to supply air through said inlet and said valve control means further comprises a valve shaft adapted to extend through said inlet along the interior of said syringe and biased into a normally closed position at said outlet.

3. The adaptor of claim 2 wherein said valve control means further comprises:

a solenoid that, upon actuation, retracts said valve shaft from said normally closed position to an open position; and a timer that actuates said solenoid.

4. The adaptor of claim 3 wherein said timer is programmable to actuate said solenoid to retract said valve shaft for a selectable duration.

5. The adaptor of claim 2 and further comprising:

a valve seat assembly adapted to coact with said valve shaft at said outlet to maintain said normally closed position and to center said valve shaft within said syringe when said syringe is held by said support means, the valve seat assembly having walls which define a passage adapted for alignment with said outlet and along which said valve shaft is retractable.

6. The adaptor of claim 5 wherein said syringe support means is a sleeve sized to receive said syringe, and further comprising:

a housing assembly adapted to support said opposite end of said sleeve; and biasing means located within said housing assembly and adapted to bias said valve shaft against said valve seat assembly when said syringe is held by said sleeve.

7. The adaptor of claim 2 and further comprising:

a retaining plug adapted to seat within said inlet of the syringe and having an orifice adapted for passage therethrough of said valve shaft and through which said air may be supplied to the interior of said syringe when said syringe support means holds the syringe.

8. The adaptor of claim 6 wherein said valve seat assembly is connected to said sleeve and said syringe outlet when the syringe is held by said sleeve.

9. The adaptor of claim 4 and further comprising:

a switch for supplying a dispensing signal to said timer in order to actuate said solenoid to retract said valve shaft for said selectable duration.

10. An adaptor for dispensing of liquid from an outlet of a syringe comprising:

syringe support means adapted to hold the syringe in a dispensing position;

a valve seat assembly located at a first end of said syringe support means;

a compressor adapted to pressurize the liquid in said syringe through a syringe inlet when said syringe is held by said support means, the syringe inlet being opposite the outlet;

a valve shaft adapted to extend from a second end of said support means through said inlet along the interior of said syringe and seat against said valve seat assembly when said syringe is held by said support means;

biasing means adapted to bias said valve shaft against said valve seat assembly to a normally closed position when said syringe is held by said support means;

retracting means adapted to retract said valve shaft from said normally closed position to enable said pressurized liquid to be ejected through said outlet and out of the syringe when said syringe is held by said support means;

wherein said valve seat assembly has a passage formed therethrough adapted for alignment with said outlet when said syringe is held by said support means, said valve shaft adapted to seat within and be retracted along said passage;

a housing assembly adapted to support said second end of said support means and in which said biasing means and said retracting means are mounted; and a micrometer mounted to said housing assembly and adapted to control the retraction distance of said valve shaft to prevent the valve shaft from being retracted beyond either one of said passage and said outlet when said syringe is held by said support means.

11. The adaptor of claim 10, wherein said syringe support means is a cylindrical sleeve sized to receive said syringe, said first end of said sleeve being threadably connectable to said valve seat assembly and further comprising:

a spring within said housing assembly adapted to bias said valve shaft against said valve seat assembly to a normally closed position when said syringe is held by said sleeve.

12. A method of dispensing liquid from an outlet of a syringe comprising the steps of:

mounting a liquid filled syringe within an adaptor;

supplying air to the interior of said syringe to pressurize said liquid;

retracting a valve shaft from a normally closed position at said outlet in order to enable the pressurized liquid to be ejected through said outlet and out of said syringe, said valve shaft extended through an inlet located opposite said outlet, along the interior of said syringe to said outlet, and being retractable along the interior of said syringe by a timer actuated solenoid.

13. The method of claim 12 wherein said timer actuates said solenoid to retract said valve shaft for a selectable duration.

* * * * *